US010870210B2

(12) United States Patent
Wang

(10) Patent No.: US 10,870,210 B2
(45) Date of Patent: Dec. 22, 2020

(54) POWER-ASSISTED FOLDING KNIFE

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Weiyi Wang, Hangzhou (CN)

(73) Assignees: HANGZHOU GREAT STAR INDUSTRIAL CO., LTD., Hangzhou (CN); HANGZHOU GREAT STAR TOOLS CO., LTD., Hangzhou (CN)

( * ) Notice: Subject to any disclaimer, the term of this patent is extended or adjusted under 35 U.S.C. 154(b) by 0 days.

(21) Appl. No.: 16/467,222

(22) PCT Filed: Dec. 30, 2016

(86) PCT No.: PCT/CN2016/113784

§ 371 (c)(1),
(2) Date: Jun. 6, 2019

(87) PCT Pub. No.: WO2018/120144

PCT Pub. Date: Jul. 5, 2018

(65) Prior Publication Data

US 2020/0078966 A1 Mar. 12, 2020

(51) Int. Cl.
*B26B 1/04* (2006.01)
*B26B 1/06* (2006.01)

(52) U.S. Cl.
CPC ..... *B26B 1/046* (2013.01); *B26B 1/06* (2013.01); *B26B 1/044* (2013.01)

(58) Field of Classification Search
CPC .. B26B 1/046; B26B 1/06; B26B 1/04; B26B 1/044
See application file for complete search history.

(56) References Cited

U.S. PATENT DOCUMENTS 6,079,106 A 6/2000 Vallotton
6,308,420 B1 * 10/2001 Moser ..... B26B 1/04 30/158

(Continued)

FOREIGN PATENT DOCUMENTS

CN 102806567 A 12/2012
CN 105856276 A 8/2016

OTHER PUBLICATIONS

International Search Report for PCT Application No. PCT/CN2016/113784, dated Sep. 14, 2017.

*Primary Examiner* — Hwei-Siu C Payer
(74) *Attorney, Agent, or Firm* — Marshall, Gerstein & Borun LLP

(57) ABSTRACT

The present invention provides a power-assisted folding knife, comprising a handle, a blade, a locking mechanism, an assisting mechanism and a second assisting mechanism. The blade is rotatably connected to the handle. The locking mechanism and the second assisting mechanism are provided inside the handle. The assisting mechanism is connected to the handle and the blade respectively. When the blade is in a folded position, the assisting mechanism and the second assisting mechanism are used for locking or unlocking the blade. When the blade is in an unfolded position, the locking mechanism is used for locking or unlocking the blade. When the power-assisted folding knife is unfolded, the assisting mechanism and the second assisting mechanism provide assisting force for the blade and/or the handle.

12 Claims, 5 Drawing Sheets

(56) References Cited

U.S. PATENT DOCUMENTS

| | | | | |
|---|---|---|---|---|
| 6,370,778 | B1 * | 4/2002 | Conable | B26B 1/042 30/160 |
| 6,378,214 | B1 | 4/2002 | Onion | |
| 6,729,029 | B1 * | 5/2004 | Chu | B26B 1/044 30/155 |
| 7,051,441 | B2 * | 5/2006 | Carter, III | B26B 1/044 30/160 |
| 7,062,856 | B2 * | 6/2006 | Moser | B26B 1/04 30/158 |
| 7,080,457 | B2 * | 7/2006 | Sullivan | B26B 1/046 30/160 |
| 7,146,736 | B1 | 12/2006 | Collins | |
| 7,246,441 | B1 * | 7/2007 | Collins | B26B 1/042 30/159 |
| 7,698,821 | B2 * | 4/2010 | Ralph | B26B 1/048 30/160 |
| 8,499,460 | B1 * | 8/2013 | Pearman | B26B 1/044 30/155 |
| 8,505,206 | B2 * | 8/2013 | VanHoy | B26B 1/044 30/159 |
| 8,893,389 | B2 * | 11/2014 | Freeman | B26B 1/046 30/155 |
| 9,707,687 | B2 * | 7/2017 | Onion | B26B 1/02 |
| 2005/0144788 | A1 | 7/2005 | Lake | |
| 2008/0083118 | A1 * | 4/2008 | Steigerwalt | B26B 1/044 30/160 |
| 2009/0144986 | A1 * | 6/2009 | Frazer | B26B 1/048 30/159 |
| 2010/0257742 | A1 * | 10/2010 | Lake | B26B 1/044 30/159 |
| 2012/0304470 | A1 | 12/2012 | Freeman | |
| 2018/0001488 | A1 * | 1/2018 | Wang | B26B 5/00 |
| 2020/0078966 | A1 * | 3/2020 | Wang | B26B 1/046 |

* cited by examiner

POWER-ASSISTED FOLDING KNIFE

FIELD OF THE INVENTION

The present invention relates to hand tools and in particular to a power-assisted folding knife.

DESCRIPTION OF THE PRIOR ART

Conventional folding knives typically require two hands to unfold or fold, and a relatively large force is needed during operation by users.

The person skilled in the art endeavors to provide a power-assisted folding knife allowing for easier and efforts-saving unfolding of the folding knife, so that a user can operate it with one hand.

SUMMARY OF THE INVENTION

One object of the present invention is to provide a power-assisted folding knife which adopts an assisting mechanism to provide an assisting force upon unfolding the folding knife to enable easier unfolding and single-hand operation of the folding knife. The power-assisted folding knife has a locking mechanism capable of locking a blade holder in an unfolded position, ensuring safe use of the power-assisted folding knife.

To solve the above technical problems, the present invention provides a power-assisted folding knife, comprising a handle, a blade, a locking mechanism, an assisting mechanism and a second assisting mechanism. The blade is rotatably connected to the handle. The locking mechanism and the second assisting mechanism are provided inside the handle. The assisting mechanism is connected to the handle and the blade respectively. When the blade is in a folded position, the assisting mechanism and the second assisting mechanism are used for locking or unlocking the blade. When the blade is in an unfolded position, the locking mechanism is used for locking or unlocking the blade. When the power-assisted folding knife is unfolded, the assisting mechanism and the second assisting mechanism provide assisting force for the blade and/or the handle.

Further, in an alternative embodiment, the assisting mechanism comprises a linkage rod, one end thereof is connected to the blade, and the other end thereof is connected to the handle.

Further, in an alternative embodiment, the linkage rod comprises a body of linkage rod, a first curved portion of linkage rod provided at one end of the linkage rod, and a second curved portion of linkage rod provided at the other end of the linkage rod.

Further, in an alternative embodiment, the body of linkage rod comprises a first linear portion perpendicularly connected to the first curved portion of linkage rod, a second linear portion perpendicularly connected to the second curved portion of linkage rod, and a bent portion used for connecting the first linear portion and the second linear portion.

Further, in an alternative embodiment, the blade comprises a blade shank rotatably connected to the handle, a mounting hole of first rotating shaft passing through the blade shank, a first rotating shaft provided at the joint of the handle and the blade shank and movably mounted inside the mounting hole of first rotating shaft, and a mounting hole of first linkage rod passing through the blade shank, the first curved portion of linkage rod being movably mounted inside the mounting hole of first linkage rod.

Further, in an alternative embodiment, the handle comprises a mounting slot of elastic member, an elastic member provided inside the mounting slot of elastic member, a sliding member slidable inside the mounting slot of elastic member and connected to the elastic member; a mounting hole of second linkage rod passing through the sliding member, the second curved portion of linkage rod being movably mounted inside the mounting hole of second linkage rod.

Further, in an alternative embodiment, during the unfolding process of the power-assisted folding knife, after a straight line where the first linear portion is has crossed over the first rotating shaft, the torque generated by the elastic force of the elastic member causes the blade and the handle to rotate in the unfolding direction, so as to provide assisting force required for unfolding the power-assisted folding knife.

Further, in an alternative embodiment, during the folding process of the power-assisted folding knife, after a straight line where the first linear portion is has crossed over the first rotating shaft, the torque generated by the elastic force of the elastic member causes the blade and the handle to rotate in the folding direction, so as to achieve locking of the power-assisted folding knife.

Further, in an alternative embodiment, the handle comprises an elastic member mounting plate with an elastic member mounting slot provided therewithin, and a first fixed mounting plate, a second fixed mounting plate, fixed to both sides of the elastic member mounting plate respectively, a first slot provided in the first fixed mounting plate, the body of linkage rod positioned inside the first slot.

Further, in an alternative embodiment, the second assisting mechanism comprises a second rotating shaft, perpendicularly fixed to the elastic member mounting plate and/or the second fixed mounting plate, and a rotating member rotatably mounted to the second rotating shaft.

Further, in an alternative embodiment, the rotating member comprises a turning piece having a middle portion thereof rotatably mounted to the second rotating shaft, the first fixed mounting plate is provided with a second slot communicated with the first slot, and the turning piece is positioned within the second slot.

Further, in an alternative embodiment, during the unfolding process of the power-assisted folding knife, the torque generated by the turning piece pushing the body of linkage rod causes the blade and the handle to rotate in the unfolding direction until a straight line where the first linear portion is has crossed over the first rotating shaft, so as to provide assisting force required for unfolding the power-assisted folding knife.

Further, in an alternative embodiment, the rotating member further comprises a press piece provided at one end of the turning piece adjacent to the first rotating shaft, being perpendicular to the turning piece, and a limit piece provided at one end of the turning piece distant from the first rotating shaft, being perpendicular to the turning piece, wherein the press piece and the limit piece are provided at both sides of the turning piece respectively.

Further, in an alternative embodiment, the blade further comprises a cutting edge of blade, the blade shank is provided with an L-shaped indentation on a side corresponding to the cutting edge of blade, and when the blade is positioned in a folded position, the limit piece is snap-fitted to the L-shaped indentation, the kinetic moment generated by the elastic member and the resisting moment generated by the limit piece causing a moment balance of the blade so as to lock the blade.

Further, in an alternative embodiment, the handle is provided with a limit key at one end adjacent to the first rotating shaft; the limit key is fixed to the second fixed mounting plate and corresponds to the blade; the blade further comprises a spine edge of blade; the blade shank is provided with a second L-shaped indentation on a side corresponding to the spine edge of blade; when the blade is positioned in an unfolded position, the limit key is snap-fitted to the second L-shaped indentation, the kinetic moment generated by the elastic member and the resisting moment generated by the limit key causing a moment balance of the blade so as to lock the blade.

Further, in an alternative embodiment, the handle comprises two outer shells of handle fixed to both sides of the elastic member mounting plate and the fixed mounting plate respectively, and a press piece exit provided on the outer shell of handle on a side corresponding to the press piece, the press piece passing through the press piece exit and protruding from the outer shell of the handle.

The invention provides a power-assisted folding knife which has the following advantages: adopting two assisting mechanisms to provide assisting force during unfolding or folding of the folding knife, to facilitate unfolding or folding of the folding knife with more ease and to enable users to operate with one hand.

Additionally, the blade may be locked in an unfolded position and/or a folded position, to ensure safe use of the folding knife.

Figure 1:
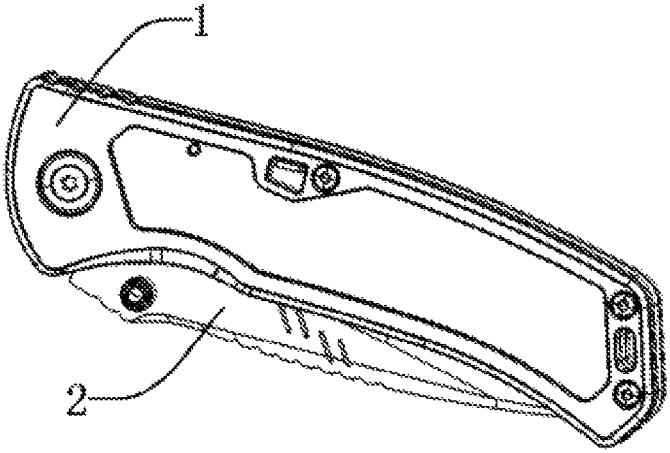
FIG. 1 is a structural schematic view of a power-assisted folding knife in a folded state in an embodiment of the invention.

The reference numerals of components are as follows:

1 handle, 2 blade, 3 assisting mechanism, 4 first rotating shaft;

5 second assisting mechanism, 6 limit key, 7 locking mechanism;

11 first fixed mounting plate, 12 second fixed mounting plate, 13 elastic member mounting plate;

14 elastic member mounting slot, 15 elastic member, 16 sliding member;

17 outer shell of handle, 18 outer shell of handle, 19 mounting hole for second linkage rod;

21 blade shank, 22 blade tip, 23 cutting edge of blade, 24 spine edge of blade;

25 mounting hole of first rotating shaft, 26 mounting hole for first linkage rod, 27 L-shaped indentation;

31 body of linkage rod, 32 first curved portion of linkage rod, 33 second curved portion of linkage rod;

51 second rotating shaft, 52 rotating member; 71 elastic sheet, 72 free end;

111 first slot, 112 second slot, 131 steel ball, 171 press piece exit;

211 second L-shaped indentation, 271 bottom face of indentation, 272 side face of indentation;

311 first linear portion, 312 second linear portion, 313 bent portion;

521 turning piece, 522 press piece, 523 limit piece, 524 mounting hole of second rotating shaft;

525 first locating hole, 526 second locating hole.

DETAILED DESCRIPTION OF THE PREFERRED EMBODIMENTS

The present invention will be described fully hereinafter with reference to the accompanying drawings, in which preferred embodiments of the invention are shown, for the purpose of clarity and better understanding of the techniques. This invention may be embodied in various forms and the invention should not be construed as being limited to the embodiments set forth herein.

In the accompanying drawings, elements with identical structure are marked with the same reference numerals, and elements with similar structure or function are marked throughout with similar reference numerals. The dimension and thickness of each of the elements in the accompanying drawings are arbitrarily shown which are not defined by the present invention. For clarity purpose, certain elements may be shown somewhat exaggerated in thickness.

Directional terms described by the present invention, such as upper, lower, front, back, left, right, inner, outer, side, top, bottom, upper end, lower end, terminal end and etc., are only directions by referring to the accompanying drawings, and are only used to explain and describe the present invention, which are not used to define the scope of the present invention.

It will be understood that when an element is referred to as being "on" another element, it can be directly on the other element, there may be an intermediate element on which it is placed, and the intermediate element is placed on the other element. When an element is referred to as being "mounted to" or "connected to" another element, either one can be understood as being directly "mounted" or "connected", or via an intermediate element to be indirectly "mounted to" or "connected to" the other element.

As shown in FIGS. 1-4, the embodiment provides a power-assisted folding knife comprising a handle 1, a blade 2, a locking mechanism 7, an assisting mechanism 3 and a second assisting mechanism 5. Blade 2 is rotatably connected to handle 1. Assisting mechanism 3 is connected to handle 1 and blade 2 respectively. Second assisting mechanism 5 and locking mechanism 7 are provided inside handle 1.

The usage states of the power-assisted folding knife mainly include an unfolded state, a folded state and an intermediate state during unfolding or folding. When the power-assisted folding knife is in the unfolded state, blade 2 is in an unfolded position; when the power-assisted folding knife is in the folded state, blade 2 is in a folded position.

When the power-assisted folding knife is being unfolded, assisting mechanism 3 may be used for providing assisting force for blade 2 and/or handle 1; when blade 2 is in the folded position, assisting mechanism 3 and second assisting mechanism 5 may be used for locking blade 2, so as to hold blade 2 and handle 1 fixed in relation to each other.

The power-assisted folding knife in the embodiment adopts an assisting mechanism, which can provide assisting force during unfolding to urge blade 2 and handle 1 to be unfolded, so as to unfold the power-assisted folding knife with more ease, and which also provides assisting force during folding to urge blade 2 and handle 1 to fold, so as to fold the power-assisted folding knife with more ease, thus enabling the one-handed operation for users.

Assisting mechanism 3 cooperates with second assisting mechanism 5, enabling blade 2 to stay in a moment balance state in the folded position, thereby achieving the locking of the blade and ensuring safe use of the power-assisted folding knife.

When blade 2 is in the unfolded position, locking mechanism 7 can achieve the locking or unlocking of the blade, ensuring safe use of the power-assisted folding knife.

In this embodiment, handle 1 includes a first fixed mounting plate 11, a second fixed mounting plate 12 and an elastic member mounting plate 13, the three of which are arranged in parallel and fitted to each other. First fixed mounting plate 11 and second fixed mounting plate 12 are fixed to both sides of elastic member mounting plate 13 respectively, and these three are fixedly mounted into an integrity through multiple sets of fasteners, such as bolts.

An elastic member mounting slot 14 is provided inside elastic member mounting plate 13, which is in a linear shape. An elastic member 15 (preferably a spring) and a sliding member 16 are provided inside the elastic member mounting slot 14. One end of the sliding member 16 is connected to the elastic member 15, which is slidable inside the elastic member mounting slot 14.

Handle 1 may also include two outer shells of handle 17, 18, respectively fixed to both sides of the first fixed mounting plate 11, the second fixed mounting plate 12 and the elastic member mounting plate 13 that are fitted to each other. Since elastic member mounting plate 13 is located between the two fixed mounting plates, specifically, two outer shells of handle 17, 18 utilize multiple sets of fasteners, such as bolts, to be fixed to both sides of first fixed mounting plate 11 and second fixed mounting plate 12 respectively.

In this embodiment, blade 2 includes a blade shank 21, a blade tip 22, a cutting edge of blade 23 and a spine edge of blade 24. Blade shank 21 is rotatably connected to handle 1. A first rotating shaft 4 is arranged at the joint of handle 1 and blade shank 21. Blade 2 also includes a mounting hole 25 of first rotating shaft 4 which passes through the blade shank 21. First rotating shaft 4 is movably mounted in the mounting hole of first rotating shaft 25.

In this embodiment, assisting mechanism 3 includes a linkage rod (see FIG. 5), one end thereof is connected to blade 2, and the other end thereof is connected to handle 1. The linkage rod includes a body 31 of the linkage rod, a first curved portion 32 of the linkage rod is provided at one end thereof, and a second curved portion 33 of the linkage rod is provided at the other end thereof.

Blade 2 is provided with a mounting hole 26 for the first linkage rod passing through blade shank 21, and first curved portion 32 of the linkage rod is movably mounted inside mounting hole 26. Sliding member 16 is provided with a mounting hole 19, and second curved portion 33 of the linkage rod is movably mounted inside mounting hole 19. When deformation happens to elastic member 15 inside elastic member mounting slot 14, sliding member 16 slides back and forth inside elastic member mounting slot 14, and first curved portion 32 of the linkage rod is fittingly rotatable inside mounting hole 26 and second curved portion 33 of the linkage rod is fittingly rotatable inside mounting hole 19, thereby enabling blade 2 to be driven by the linkage rod, providing linkage effect.

Figure 5:
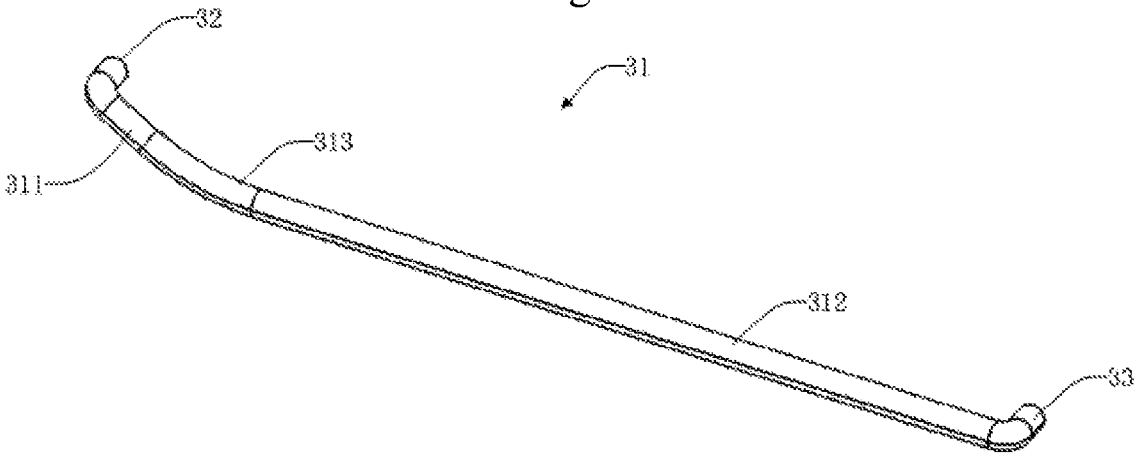
FIG. 5 is a structural schematic view of a body of a linkage rod in an embodiment of the invention.

As shown in FIG. 5, body of linkage rod 31 includes a first linear portion 311, a second linear portion 312 and a bent portion 313 used for connecting the two linear portions. First linear portion 311 is perpendicularly connected to first curved portion 32 of the linkage rod, and second linear portion 312 is perpendicularly connected to second curved portion 33 of the linkage rod.

As shown in FIGS. 5-8, during the unfolding or folding of the power-assisted folding knife, the elastic force generated by elastic member 15 is passed to body of linkage rod 31 through sliding member 16, and acts onto blade shank 21 through first curved portion 32, the forced direction of blade 2 is a straight line where the first linear portion 311 is.

During the unfolding process of the power-assisted folding knife, after the straight line where first linear portion 311 is has crossed over first rotating shaft 4, the torque generated by the elastic force of elastic member 15 causes blade 2 and handle 1 to rotate in the unfolding direction, so as to provide assisting force required for unfolding the power-assisted folding knife.

During the folding process of the power-assisted folding knife, spine edge of blade 24 of blade 2 is subjected to a pushing force towards the folding direction, thereby causing blade 2 to move in the folding direction. After the straight line where the first linear portion 311 is has crossed over first rotating shaft 4, the torque generated by the elastic force of elastic member 15 causes blade 2 and handle 1 to rotate in the folding direction, so as to achieve the locking of the power-assisted folding knife.

Figure 3:
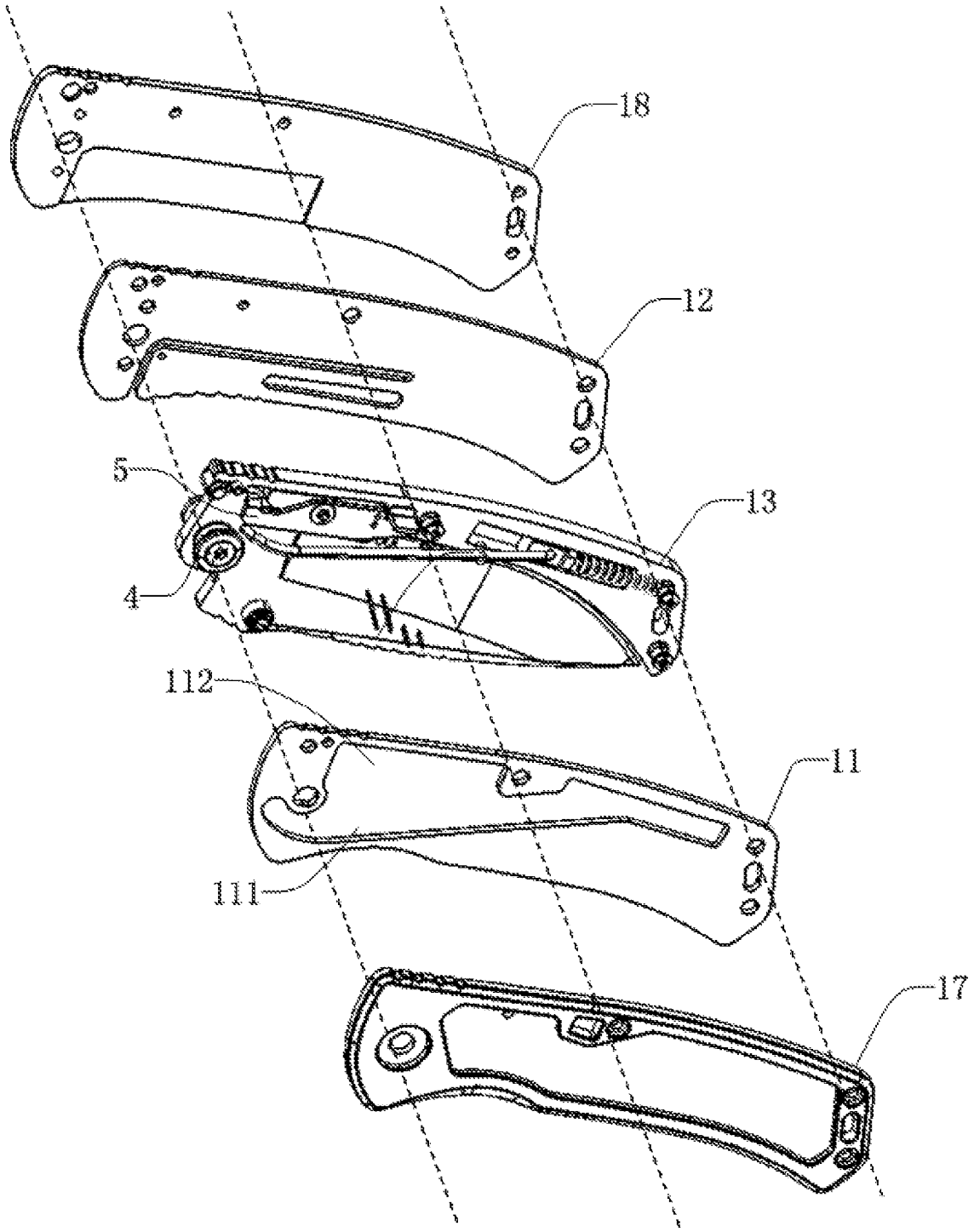
FIG. 3 is an exploded structural schematic view of a power-assisted folding knife in a folded state in an embodiment of the invention.
Figure 4:
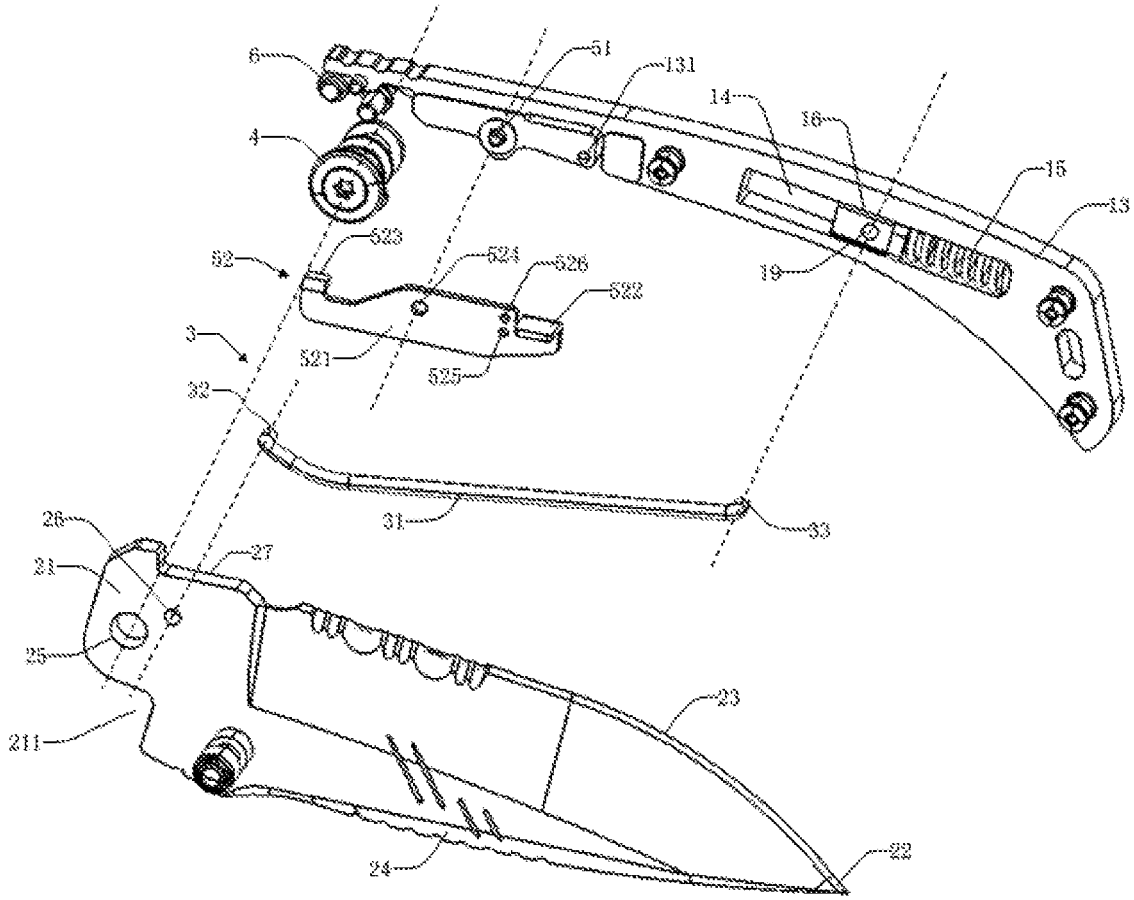
FIG. 4 is an exploded structural schematic view of an assisting mechanism in a folded state in an embodiment of the invention.

As shown in FIGS. 3-4, when blade 2 is in the folded position, second assisting mechanism 5 cooperates with assisting mechanism 3, thereby causing blade 2 to be in a moment balance state in the folded position, so as to achieve the locking of blade 2, keeping blade 2 relatively fixed in relation to handle 1 and ensuring the safe use of the power-assisted folding knife. When blade 2 is being unfolded, second assisting mechanism 5 is used for unlocking blade 2. Second assisting mechanism 5 cooperates with assisting mechanism 3 to provide assisting force during unfolding of the power-assisted folding knife, enabling the power-assisted folding knife to be unfolded with more ease and to be operated with one hand.

The second assisting mechanism 5 includes a second rotating shaft 51 and a rotating member 52, second rotating shaft 51 being perpendicularly fixed to elastic member mounting plate 13 and/or second fixed mounting plate 12. Rotating member 52 also includes a mounting hole of second rotating shaft 524 passing through turning piece 521 and provided circumferentially outside second rotating shaft 52, thereby enabling rotating member 52 to be rotatably mounted to second rotating shaft 51.

Rotating member 52 includes a turning piece 521, a press piece 522 and a limit piece 523, the three of which are integrally structured, and the middle portion of turning piece 521 is rotatably mounted to the second rotating shaft 51.

First fixed mounting plate 11 is provided with a first slot 111, and body of linkage rod 31 is positioned inside first slot 111. First fixed mounting plate 11 is provided with a second slot 112, and turning piece 521 is positioned inside second slot 112. First slot 111 and second slot 112 are communicated with each other, and turning piece 521 and body of linkage rod 31 are located in the same plane.

Figure 7:
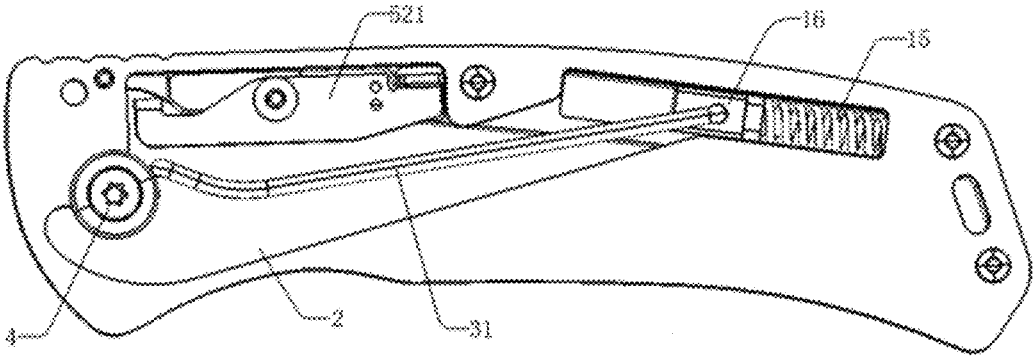
FIG. 7 is a structural schematic view of the inside of a handle in a folded state in an embodiment of the invention.
Figure 8:
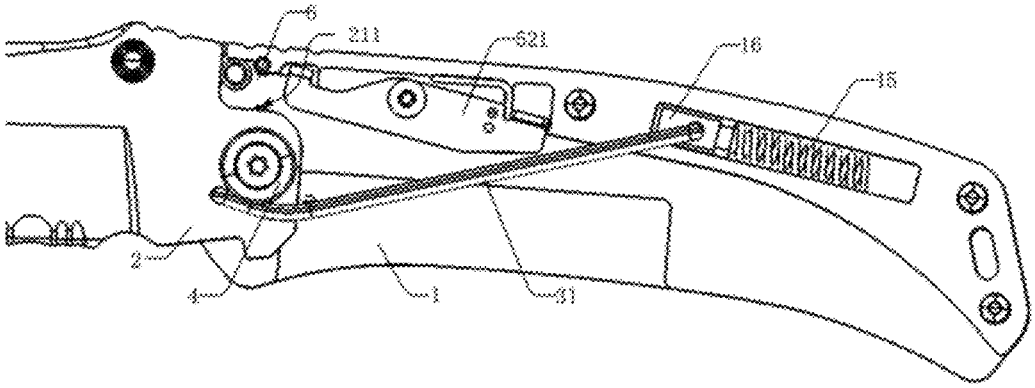
FIG. 8 is a structural schematic view of the inside of a handle in an unfolded state in an embodiment of the invention.

As shown in FIG. 4, a press piece 522 is provided at one end of turning piece 521 adjacent to first rotating shaft 4 and is perpendicular to turning piece 521. A limit piece 523 is provided at one end of turning piece 521 distant from first rotating shaft 4 and is perpendicular to turning piece 521. Press piece 522 and limit piece 523 are provided at both sides of the turning piece 521 respectively. Press piece 522 and limit piece 523 are both positioned on the upper end of turning piece 521, and the blade shank 21 is provided with an L-shaped indentation 27 on a side corresponding to the cutting edge of blade 23. When blade 2 is positioned in a folded position, limit piece 523 is snap-fitted to L-shaped indentation 27. As shown in FIGS. 7-8, turning piece 521 is located above body of linkage rod 31, and is integrally arranged with press piece 522 and limit piece 523.

Figure 6:
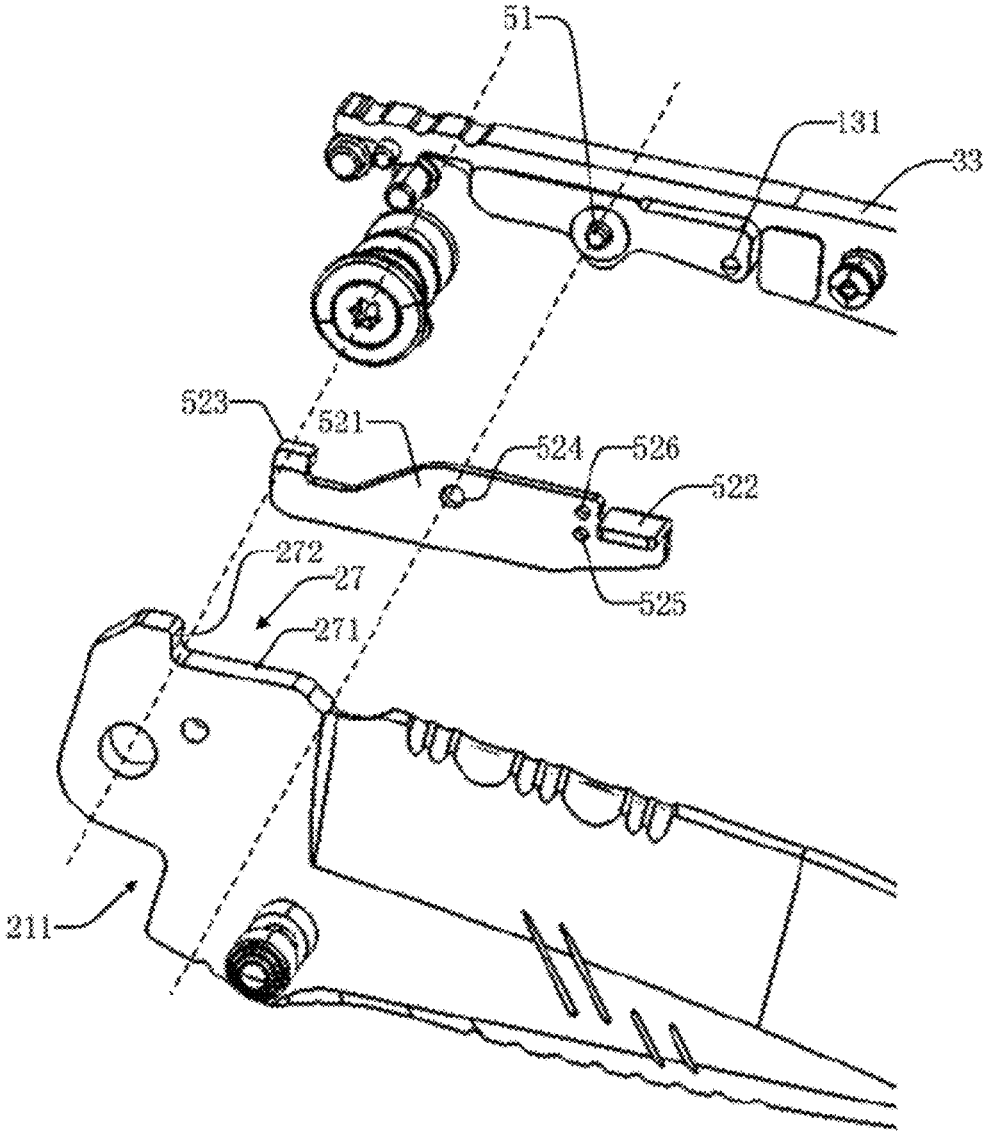
FIG. 6 is an exploded structural schematic view of a second assisting mechanism in a folded state in an embodiment of the invention.

As shown in FIG. 6, L-shaped indentation 27 includes a bottom face of indentation 271 and a side face of indentation 272. When blade 2 is in a folded position, bottom face of indentation 271 is tangential to the surface of limit piece 523. Meanwhile, side face of indentation 272 may also be tangential to the side face of limit piece 523. Then, the kinetic moment produced by elastic member 15 and the resisting moment produced by limit piece 523 cause a moment balance of blade 2, so as to lock the power-assisted folding knife.

As shown in FIG. 6, rotating member 52 also includes two locating holes passing through turning piece 521, specifically including a first locating hole 525 and a second locating hole 526. The distance between first locating hole 525 and mounting hole 19 is equal to the distance between second locating hole 526 and mounting hole 19. A steel ball 131 is embedded into the surface of the outer side face of elastic member mounting plate 13 on a side adjacent to the turning piece 521. Steel ball 131 may be snap-fitted to any one of locating holes 525, 526. The distance between steel ball 131 and second rotating shaft 51 is equal to the distance between second locating hole 526 or the locating hole and the mounting hole of second rotating shaft.

As shown in FIGS. 6-8, when the power-assisted folding knife is in a folded state, steel ball 131 is snap-fitted to first locating hole 525. When blade 2 is being unfolded, steel ball 131 is snap-fitted to second locating hole 526, thereby enabling rotating member 52 to be kept relatively fixed inside handle 1.

Figure 2:
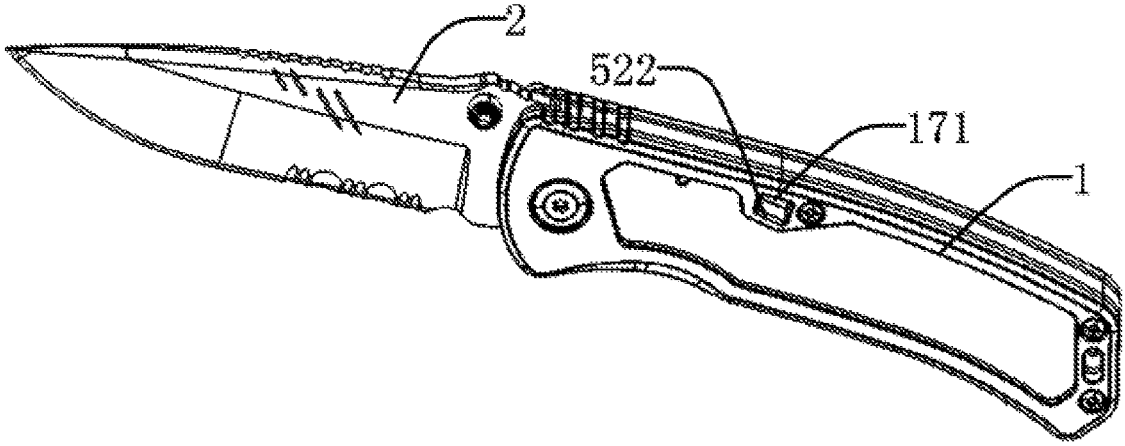
FIG. 2 is a structural schematic view of a power-assisted folding knife in an unfolded state in an embodiment of the invention.

As shown in FIGS. 2-4, handle 1 includes a press piece exit 171, provided in the outer shell of handle 17 on a side corresponding to press piece 522. Press piece 522 passes through press piece exit 171 and protrudes from the outer shell of handle 17. That is to say, press piece 522 protrudes from the outer surface of handle 1 for facilitating pressing by users.

As shown in FIG. 6 and FIG. 8, handle 1 is provided with a limit key 6 on an end adjacent to first rotating shaft 4, and limit key 6 is fixed to second fixed mounting plate 12 and corresponds to blade 2. Blade shank 21 is provided with a second L-shaped indentation 211 on a side corresponding to spine edge of blade 24. When blade 2 is positioned in an unfolded position, limit key 6 is snap-fitted to second L-shaped indentation 211, so as to prevent blade 2 from rotating toward a larger angle.

Figure 9:
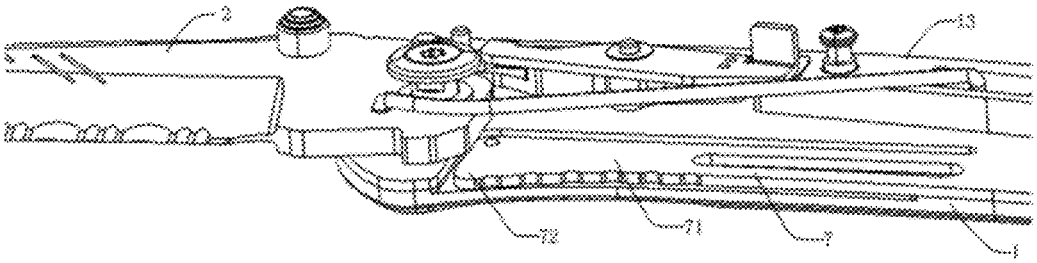
FIG. 9 is a structural schematic view of a side lock in an unfolded state in an embodiment of the invention.

Locking mechanism 7 in this embodiment is preferably a side lock, as shown in FIG. 9. The side lock is an elastic sheet 71, one end thereof being connected to second fixed mounting plate 12 and the other end thereof being free and elastic. When the power-assisted folding knife is being unfolded, elastic sheet 71 springs out toward the side of elastic member mounting plate 13, and the free end 72 that sprang out is facing blade shank 21, preventing blade 2 from rotating toward handle 1. Elastic sheet 71 and second L-shaped indentation 211 are cooperating with each other, then blade 2 can be locked in the unfolded position. When the power-assisted folding knife needs to be folded, the user presses the side lock toward the inside of handle 1, elastic sheet 71 detaching from blade shank 21, enabling blade 2 to rotate in a direction toward the handle. The locking mechanism may also adopt locking mechanisms such as a back lock. The locking mechanisms in the prior art are abundant, which would not be narrated herein.

In the application of this embodiment, the usage states of the power-assisted folding knife mainly include the unfolded state, the folded state and an intermediate state during unfolding or folding.

As shown in FIG. 7, in the folded state of the power-assisted folding knife, elastic member 15, preferably a spring, is under a compressed state, at this time, the elastic force generated by elastic member 15 is passed to body of linkage rod 31 through sliding member 16, and acts onto blade shank 21 through first curved portion 32, the forced direction of blade 2 is a straight line where first linear portion 311 is. The elastic force of elastic member 15 generates a kinetic moment urging blade 2 to move deeper towards blade shank 1. Meanwhile, limit piece 523 is snap-fitted to L-shaped indentation 27, producing a resisting moment against blade 2, enabling the blade to be in a moment balance state, thereby enabling blade 2 to be in a locking state.

The process of unfolding of the power-assisted folding knife is as follows, shown as in FIGS. 7-8, the user presses down press piece 522 protruding from the outer surface of handle 1, turning piece 521 rotating downwardly, the lower end of turning piece 521 being able to push body 31 of linkage rod to move downwardly. Meanwhile, limit piece 523 is lifted upwardly and detaches from L-shaped indentation 27, thereby releasing the locking of the blade. Body 31 of linkage rod is subjected to a downward force which drives the blade to be unfolded. During the unfolding process, after a straight line where the first linear portion 311 is has crossed over first rotating shaft 4, the elastic force generated by elastic member 15 is passed to body of linkage rod 31 through sliding member 16, and acts onto blade shank 21 through first curved portion 32, the forced direction of blade 2 is a straight line where first linear portion 311 is. The kinetic moment generated by the elastic force of elastic member 15 urges blade 2 to rotate in a direction toward unfolding, so as to provide assisting force required for unfolding the power-assisted folding knife. When elastic member 15 has restored its original form, the elasticity is absent, producing no more kinetic moment, and blade 2 continues to rotate in the direction toward unfolding under the effect of inertia, so that the power-assisted folding knife is enabled to be unfolded.

When blade 2 is unfolded to the unfolded position, limit key 6 is snap-fitted to the second L-shaped indentation 211, elastic sheet 71 springs out toward the side of elastic member mounting plate 13, and free end 72 that sprang out is facing blade shank 21, preventing blade 2 from rotating toward handle 1. Elastic sheet 71 and second L-shaped indentation 211 are cooperating with each other, then blade 2 can be locked in the unfolded position.

The folding process of the power-assisted folding knife is as follows: the side lock is pressed toward the inside of handle 1, so that elastic sheet 71 detaches from blade shank 21 to release the locking of blade 2. Then, under the condition that handle 1 is kept stationary, the user applies a pushing force onto spine edge of blade 24 in a direction toward folding direction, thereby urging blade 2 to fold in a direction toward the handle. During the folding process, elastic member 15 has not been deformed in a starting phase, and would not produce elastic force, avoiding the need of conquering a relatively large resistance in the starting phase of intaking the blade, which makes it hard for the blade to be folded and prevent injuries caused by improper operations. When the straight line where the first linear portion 311 is has crossed over first rotating shaft 4, the user does not need to apply pushing force any more onto spine edge of blade 24. At this time, elastic member 15 is deformed, and the torque generated by the elastic force can urge blade 2 to rotate in a direction towards folding, so that the power-assisted folding knife is enabled to be folded.

When blade 2 has reached the folded position, the power-assisted folding knife is in the folded state, and the resultant torque that blade 2 subjected to is under a balanced state again, thereby achieving the locking of the power-assisted folding knife again.

The present invention provides a power-assisted folding knife which has the following advantages: adopting two assisting mechanisms to provide assisting force during unfolding or folding of the folding knife, to facilitate unfolding or folding of the folding knife with more ease and to enable users to operate with one hand. Additionally, the blade may be locked in an unfolded position and/or a folded position, so as to ensure safe use of the folding knife.

The preferred specific embodiments of the invention have been described in detail above. It is to be understood that numerous modifications and variations can be made by those ordinary skilled in the art in accordance with the concepts of the present invention without any inventive effort. Hence, the technical solutions that may be derived by those skilled in the art according to the concepts of the present invention on the basis of the prior art through logical analysis, reasoning and limited experiments should be within the scope of protection defined by the claims.

The invention claimed is:

1. A power-assisted folding knife, comprising:
a handle,
a blade rotatably connected to the handle,
a locking mechanism used for locking or unlocking the blade when the blade is in an unfolded position,
wherein the power-assisted folding knife further comprising:
a first assisting mechanism connected to the handle and the blade respectively,
a second assisting mechanism provided inside the handle,
when the blade is in a folded position, the first assisting mechanism and the second assisting mechanism are used for locking or unlocking the blade,
when the power-assisted folding knife is unfolded, the first assisting mechanism and the second assisting mechanism provide assisting force for the blade and/or the handle;
wherein the first assisting mechanism comprises a linkage rod, one end thereof is connected to the blade, and the other end thereof is connected to the handle;
wherein the linkage rod comprises:
a body,
a first curved portion provided at one end of the linkage rod, and
a second curved portion provided at the other end of the linkage rod;
wherein the body comprises:
a first linear portion, perpendicularly connected to the first curved portion,
a second linear portion, perpendicularly connected to the second curved portion, and
a bent portion, connecting the first linear portion and the second linear portion.

2. The power-assisted folding knife according to claim 1, wherein the blade comprises:
a blade shank rotatably connected to the handle,
a first mounting hole passing through the blade shank, a first rotating shaft provided at the joint of the handle and the blade shank and movably mounted inside the first mounting hole, and
a second mounting hole passing through the blade shank, the first curved portion of the linkage rod being movably mounted inside the second mounting hole.

3. The power-assisted folding knife according to claim 2, wherein the handle comprises:
a mounting slot,
an elastic member provided inside the mounting slot,
a sliding member slidable inside the mounting slot and connected to the elastic member,
a third mounting hole passing through the sliding member, the second curved portion of the linkage rod being movably mounted inside the third mounting.

4. The power-assisted folding knife according to claim 3, wherein during an unfolding process of the power-assisted folding knife, after a straight line where the first linear portion has crossed over the first rotating shaft, the torque generated by the elastic force of the elastic member causes the blade to rotate in an unfolding direction, so as to provide assisting force required for unfolding the power-assisted folding knife.

5. The power-assisted folding knife according to claim 3, wherein during a folding process of the power-assisted folding knife, after a straight line where the first linear portion has crossed over the first rotating shaft, the torque generated by the elastic force of the elastic member causes the blade to rotate in a folding direction, so as to achieve locking of the power-assisted folding knife.

6. The power-assisted folding knife according to claim 3, wherein the handle comprises:
an elastic member mounting plate with the mounting slot provided therewithin, and
a first fixed mounting plate, a second fixed mounting plate, fixed to both sides of the elastic member mounting plate respectively,
a first slot provided in the first fixed mounting plate, the body of the linkage rod positioned inside the first slot.

7. The power-assisted folding knife according to claim 6, wherein the second assisting mechanism comprises:
a second rotating shaft perpendicularly fixed to the elastic member mounting plate and/or the second fixed mounting plate,
a rotating member rotatably mounted to the second rotating shaft.

8. The power-assisted folding knife according to claim 7, wherein
the rotating member comprises a turning piece having a middle portion thereof rotatably mounted to the second rotating shaft, the first fixed mounting plate is provided with a second slot communicated with the first slot, the turning piece is positioned within the second slot, during the unfolding process of the power-assisted folding knife, the torque generated by the turning piece pushing the body of the linkage rod causes the blade to rotate in the unfolding direction until the straight line where the first linear portion has crossed over the first rotating shaft, so as to provide assisting force required for unfolding the power-assisted folding knife.

9. The power-assisted folding knife according to claim 8, wherein the rotating member further comprises:

a press piece provided at one end of the turning piece adjacent to the first rotating shaft, being perpendicular to the turning piece, a limit piece provided at the other end of the turning piece distant from the first rotating shaft, being perpendicular to the turning piece, wherein the press piece and the limit piece are provided at both sides of the turning piece respectively.

10. The power-assisted folding knife according to claim 9, wherein the blade further comprises a cutting edge, the blade shank is provided with an L-shaped indentation on a side thereof corresponding to the cutting edge, when the blade is positioned in the folded position, the limit piece is snap-fitted to the L-shaped indentation, the kinetic moment generated by the elastic member and the resisting moment generated by the limit piece causing a moment balance of the blade, so as to lock the blade.

11. The power-assisted folding knife according to claim 9, wherein the handle is provided with a limit key at one end thereof adjacent to the first rotating shaft, the limit key is fixed to the second fixed mounting plate and corresponds to the blade, the blade further comprises a spine edge, the blade shank is provided with a second L-shaped indentation on a side thereof corresponding to the spine edge, when the blade is positioned in the unfolded position, the limit key is snap-fitted to the second L-shaped indentation, the kinetic moment generated by the elastic member and the resisting moment generated by the limit key causing a moment balance of the blade so as to lock the blade.

12. The power-assisted folding knife according to claim 9, wherein the handle comprises:

a first outer shell fixed to a side of the first fixed mounting plate opposite to the elastic member mounting plate, and a second outer shell fixed to a side of the second fixed mounting plate opposite to the elastic member mounting plate; and a press piece exit provided on a corresponding one of the first and second outer shells on a side corresponding to the press piece, the press piece passing through the press piece exit and protruding from the corresponding outer shell.

* * * * *